United States Patent [19]

Reber

[11] 4,441,750

[45] Apr. 10, 1984

[54] CARGO SLING SYSTEM FOR A HELICOPTER

[75] Inventor: Dwight E. Reber, Aurora, Oreg.

[73] Assignee: Columbia Helicopters, Inc., Portland, Oreg.

[21] Appl. No.: 303,006

[22] Filed: Sep. 17, 1981

[51] Int. Cl.[3] ..... B66C 1/38

[52] U.S. Cl. ..... 294/83 R; 294/74

[58] Field of Search ..... 294/74, 75, 76, 78 R, 294/81 R, 83 R, 83 A, 84

[56] References Cited

U.S. PATENT DOCUMENTS

| | | | |
|---|---|---|---|
| 2,673,116 | 3/1954 | Baird | 294/75 |
| 4,149,746 | 11/1979 | Androski | 294/74 |
| 4,185,862 | 1/1982 | Slocombe | 294/74 |

*Primary Examiner*—James B. Marbert

*Attorney, Agent, or Firm*—James D. Givnan, Jr.

[57] ABSTRACT

A sling system is disclosed for suspension from a helicopter with the system including a remotely actuable hook assembly from one hook of which the ends of the loaded sling lines may be released permitting sling separation from the cargo without manual effort. A guide includes ring-like retainers through which the sling lines pass after passage about the load. A tag line between the cargo hook assembly and the guide permits lifting of the guide during load separation resulting in downward passage of the load biased sling lines therepast and ultimately retraction of the sling lines from about the load. Another hook component of the hook assembly is also remotely actuable to release the tag line, the guide and unloaded sling lines carried thereby at a sling rewinding site whereat the guide is mounted within a winding mechanism facilitating winding of the lines about the guide. A holder for the guide is also disclosed permitting guide rotation during paying out of the sling and tag lines.

10 Claims, 10 Drawing Figures

CARGO SLING SYSTEM FOR A HELICOPTER

BACKGROUND OF THE INVENTION

The present invention relates generally to a sling arrangement carried by a prime mover for securement to a load and one for rapid load discharge and sling disengagement at a discharge site both of the latter without the aid of ground attendants.

Aerial transport of logs by helicopter has now become commonplace by reason of the savings realized primarily in the avoidance of road building costs especially in areas of rough terrain. Further, airlifting avoids environmental damage to forests heretofore caused by logging vehicles and related equipment. More recently helicopters have proved to be highly suitable for the harvesting of Christmas trees where the trees are grown on a large commercial scale.

In use presently are elongate, fabricated slings which ground attendants must wrap about the sizable bundle of collected trees weighing several hundreds of pounds. The tree bundle is then airlifted to a discharge site whereat the sling must be manually removed from the deposited tree bundle. As the bundles are several hundreds of pounds in wight and several feet in height, the matter of manually extracting the sling from about the bundle is extremely arduous and time consuming. Accordingly, to prevent airlifting operations from being paced by the availability of slings it has heretofore been the practice for the helicopter contractor to use several of the costly slings and several attendant crews at any one airlifting operation. This practice is extremely costly as each sling represents a sizable investment. Additionally, the difficult task of separating slings from the tree bundle requires several crews of support workers to remove same, roll the slings and carry same back to the tree harvesting site, the latter contributing to a high labor expense.

A still further drawback to known slings is the use of wooden spreaders of block shape at intervals along the parallel sling lines. The spreaders render sling retraction from beneath a tree bundle difficult in view of the spreaders tending to hang-up on tree branches and tree trunks.

SUMMARY OF THE PRESENT INVENTION

The present invention is embodied in a sling system wherein a sling, after initial load attachment, may be both tightened about and extracted from a deposited tree bundle, or other load, without ground crew effort to greatly reduce the labor effort required of ground personnel and, more importantly, the costly flight time of the load transporting helicopter.

In the present system, the sling utilizes sling lines which are drawn upwardly through a line guide during load lifting to close the sling about the load. At a load discharge site, a remotely actuable hook assembly releases one pair of sling line ends to permit the ends to be drawn through retainers on the line guide. The sling lines, after guide separation, are thereafter linearly extracted from the load by further ascent of the aircraft. A tag line from the hook assembly to the guide imparts lifting forces to the line guide for upward separation of same from the downwardly moving sling ends. Later release of the tag line from the hook assembly permits the sling to be dropped at a sling rewinding site for later convenient transfer to a tree loading site.

The present sling system has proved highly successful in the transporting of bundled Christmas trees from a cutting site to a collection point for truck loading. Additional uses of the sling system, with the same or other prime movers, will become apparent to others skilled in the present art.

Important objectives of the present system include the provision of a sling of low cost construction which may be removed from about a deposited load at a discharge site by a lifting force exerted by the prime mover; the provision of a sling wherein a sling line guide is elevated by a prime mover so as to slidably disengage released sling ends to permit linear extraction of the sling lines from beneath a deposited load by the prime mover; the provision of a sling which may be dropped at a sling rewinding station whereat the entire sling is wound into a compact bundle for convenient transfer to a sling loading site; the provision of a sling dispensing with costly manual sling unloading effort at the unloading site; the provision of a sling for operating with a multi-hook assembly carried by a helicopter long line and equipped with electrically actuated, independent hook components.

DETAILED DESCRIPTION OF THE PREFERRED EMBODIMENT

Figures 1, 2, 3, 4, 5:
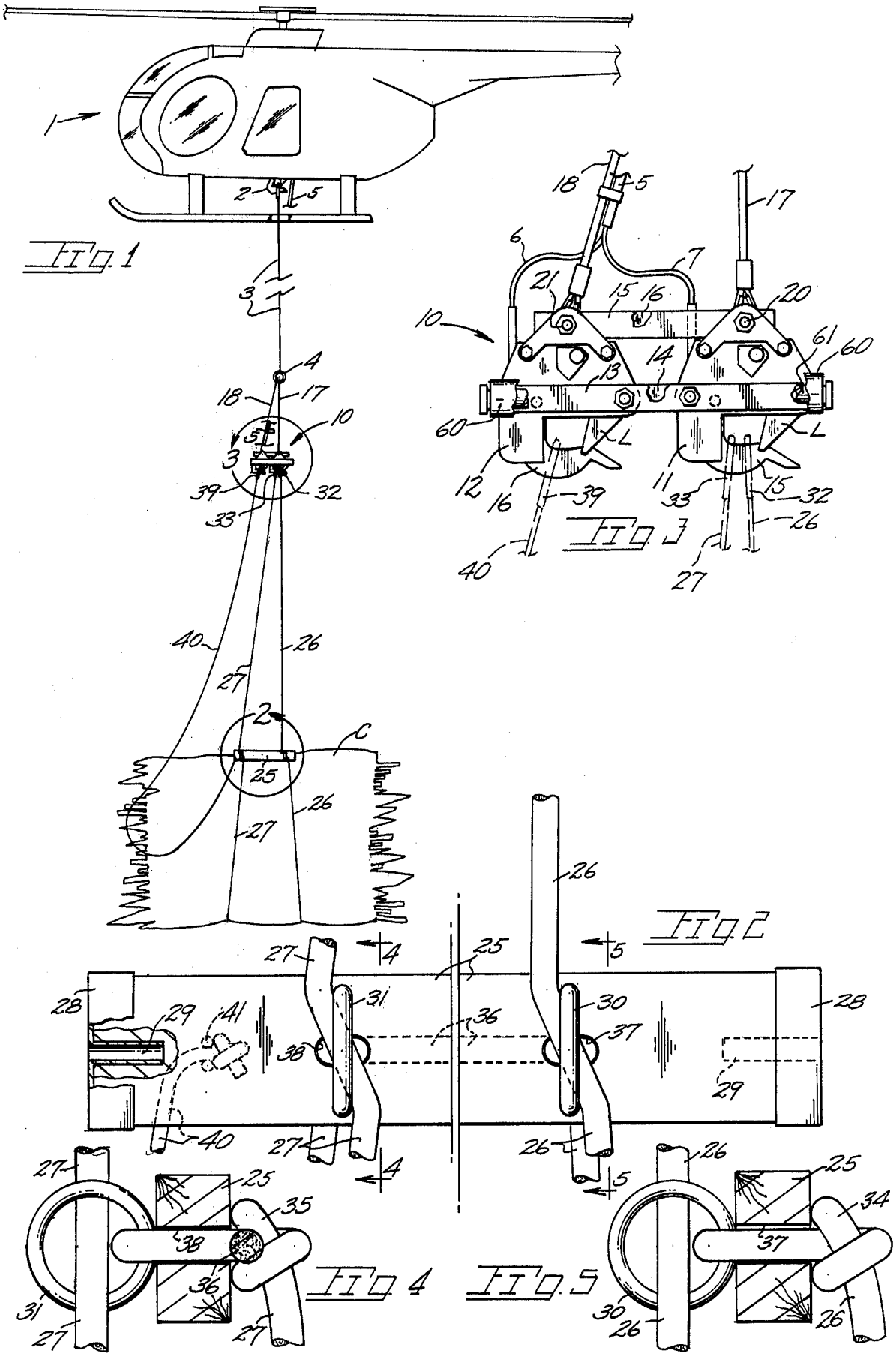
FIG. 1 is a side elevational view of a helicopter shown airlifting a load of bundled Christmas trees with the aircraft long line sectioned for convenience of illustration.
FIG. 2 is an enlarged view of a sling guide encircled at 2 in FIG. 1 and sectioned for purposes of illustration.
FIG. 3 is an enlarged view of a hook assembly encircled at 3 in FIG. 1.
FIGS. 4 and 5 are vertical sectional views taken along line 4—4 and 5—5 of FIG. 2.
Figure 6:
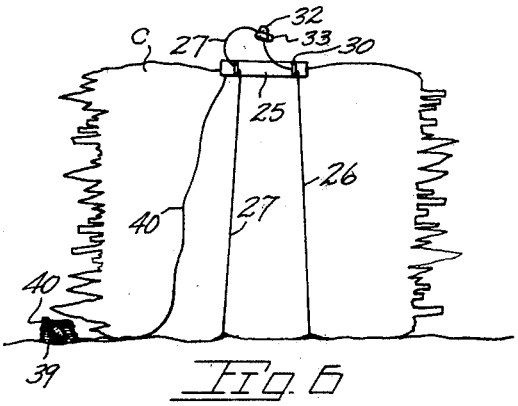
FIG. 6 is a side elevational view of a Christmas tree bundle with the present sling in place thereon but prior to sling attachment to the prime mover carried hook assembly.

With continuing reference to the drawings, the applied reference numeral 1 indicates generally a helicopter constituting a prime mover to the present sling system. Other prime movers may include cranes and the like, the prime mover being determined by the type of cargo being dealt with and the specific location of use.

The helicopter is conventionally equipped with a load hook at 2 from which a line 3, termed a long line, is suspended. Line 3 is fitted with a ring 4 at its lower end. An electrical conduit at 5 extends from the helicopter down the length of long line 3 to provide a pair of insulated conductors 6 and 7 which are in circuit with panel mounted switches in the aircraft cockpit and with solenoids associated with external cargo hooks as later described.

A cargo hook assembly is indicated generally at 10 and comprises part of the present sling system. Essentially, the hook assembly consists of electrically actuated first and second hook components 11 and 12 joined in tandem by side rail members 13 and 14 and connector plates 15 and 16 and suitable fastener assemblies. The hook components are of the type commonly used by those engaged in the aerial transport of cargo by helicopter where the load is external and wherein a capability is desired of load release by remote hook operation. One such hook component found highly suitable for present purposes is that manufactured by Eastern Rotorcraft, Model SP 4232-31. Other equivalent hook components may be substituted for the above hook component. As the aforementioned hook components are known in the present field, a detailed description is believed superfluous.

The first and second hook components at 11-12 each include a hook 15-16 normally held in a raised or latched position for load support. A spring biased safety latch L prevents accidental load release. Energizing of the independent hook component solenoids by closure of one or the other of the above mentioned cockpit switches, one each in circuit with conductors 6 and 7, unlocks the associated hook for load release. The hook assembly is coupled to the aircraft long line by short cable lengths at 17 and 18. Fasteners at 20-21 receive the lower ends of the cable lengths. The unseen side of the hook assembly shown in FIG. 3 would be substantially a mirror image of the FIG. 3 view.

A sling guide is indicated at 25 and is of rigid block-like construction. End caps 28 for the guide include sockets 29 which provide bearing surfaces as later noted in connection with a line winding mechanism. Sling means shown as lines or slings 26 and 27 which terminate at their corresponding lower ends at said guide. The sling lines are intended for downward passage about a load, thence upwardly through ring-shaped retainers 30 and 31 on the guide and thence upwardly terminating at end mounted eyes 32 and 33. Said eyes are jointly carried by first hook component 11 in a releasable manner. The opposite or lower ends of the slings are secured, as aforesaid, to the sling guide with such securement effected by simply using one length of sling rope knotted at 34 and 35 with a connecting rope segment 36 therebetween. Obviously, if desired the rope slings may be of separate lengths of rope each secured in a suitable manner to the guide. The ropes, adjacent the knots, pass in a doubled back manner through openings 37-38 in the guide to secure in place the ring-like retainers 30 and 31 in upright position on the normally horizontal guide. In a load carrying configuration, the rope slings 26 and 27 each pass through their respective retainers in the same direction, as shown in FIG. 2, which is of importance during sling release as later elaborated upon.

Figure 8:
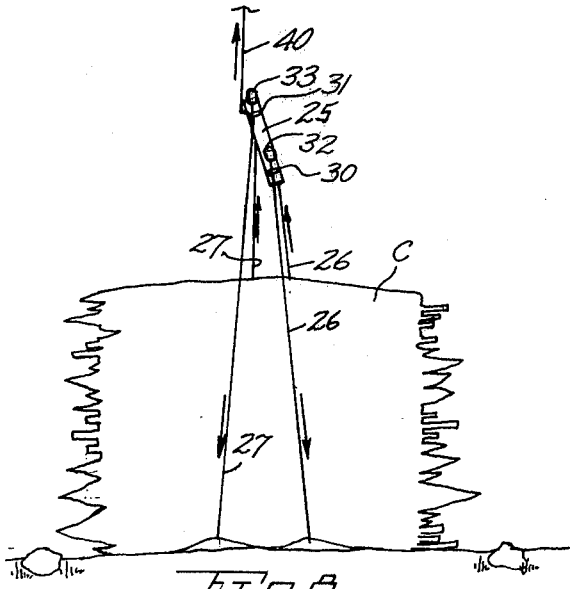
FIG. 8 is a side elevational view of the Christmas tree bundle shown in FIG. 7 with the unhooked sling being unwound from about the bundle by the unwardly tensioned sling tag line.

The guide additionally carries one end of a tag line at 40. The tag line is suitably secured to the guide as by a fastener 41 adjacent one end thereof so as to tip the guide to an upright position when the tag line is tensioned upwardly, as shown in FIG. 8, during a load releasing sequence. During load transport the tag line is slack and becomes taut only during upward tensioning and removal of the slings from about a load and subsequent transfer of the open sling to a release point. Tag line 40 is also provided with an eye at 39 at its upper end for purposes of engagement with the second hook component 12 of cargo hook assembly 10.

The cargo hook assembly 10 is permanently attached by ferrule equipped cable lengths 17-18 to long line ring 4 while the remainder of the sling system below the hook assembly is separable after load discharge.

In operation, a number of sling and guide combinations are provided to a loading crew. The air of sling lines are laid out in parallel fashion to receive a load placed approximately over a mid-portion of the two lines. The sling guide having one set of sling ends in place thereon is then placed atop the load. The remaining sling ends, equipped with eyes 32-33, is lifted upwardly about the other side of the load with the eyes being manually passed through (in the same direction) the ring-like retainers 30-31 on the guide per FIG. 2. The eyes 32-33 may thence be interfitted, one within the other, to temporarily secure same together until the eyes are to be attached to hook component 11. During this above described sling-to-load attachment operation the tag line 40 is off to one side of the load.

Pick-up by the prime mover entails downward positioning of cargo hook assembly 10 into proximity both with the load and the sling eyes 32-33 whereupon a loading crew member places each eye 32-33 onto hook 15 of the first hook component. The tag line eye 39 is then attached to the hook 16 of the second hook component with slack at all times in the tag line during load transport.

Ascent of the helicopter will cause closing of the sling lines about the load as the lines are drawn upwardly through the ring-like retainers by the elevation of the long line and cargo hook assembly 10. Tag line 40 remains in a slacked condition.

At a load discharge site the load is set in place on the ground. Aircrew actuation of a hook control switch in the cockpit causes first hook component 11 to open downwardly to release eyes 32-33 at the ends of two sling lines 26-17. Slow ascent of the helicopter causes the two sling lines to be drawn downwardly in trail while simultaneously, guide 25 is being tilted upright and lifted by the action of tag line 40. Sling line eyes 32-33 eventually encounter and pass through the now horizontal ring-like retainers 30-31 on the upwardly moving guide (FIG. 8), now being lifted by taut line 40, whereafter the released sling ends and the eyes are drawn beneath the load and ultimately upward completing separation from the ground supported load or cargo C.

Figure 9:
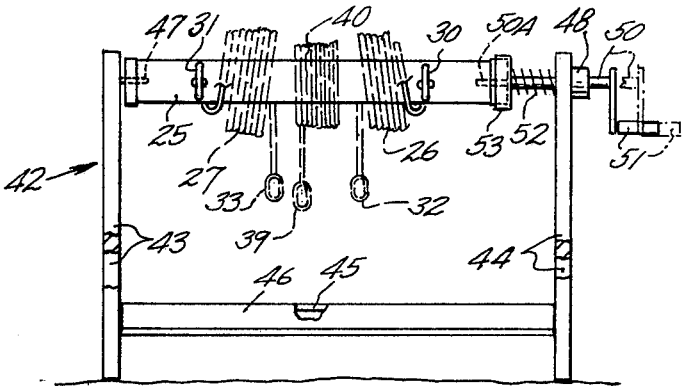
FIG. 9 is a front elevational view of a sling winding mechanism enabling rapid winding of a sling about its guide bar.
Figure 7:
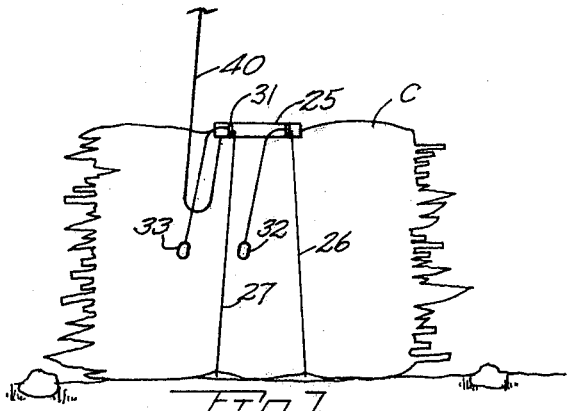
FIG. 7 is a side elevational view of a Christmas tree bundle after delivered placement on the ground and after hook assembly release of corresponding sling ends.

Tag line 40 serves thereafter to carry the guide and sling lines to a drop site whereat ground personnel may install guide 25 on a winder mechanism, generally at 46 in FIG. 9, for rapid winding of the sling lines and tag line about the guide.

With attention to FIG. 9, a sling winder mechanism includes a base frame comprised of pairs of inclined legs 43-44 cross braced at 45 and 46. The upper ends of said pairs of legs are joined with legs 43 serving to mount a pintle 47. The remaining pair of legs 44 terminates upwardly to provide a mounting surface for a bearing 48 within which is rotatably and slidably journaled a shaft 50 fitted with a hand crank 51. A helical spring 52 about shaft 50 biases said shaft inwardly as well as a clevis 53 thereon in an upward direction. A shaft end at 50A extends through the clevis and is adapted for seated engagement within a socket 29 formed within one end of guide 25. Shaft 50 is outwardly retractable against the action of spring 52 for the purpose of permitting guide installation on pintle 47 and subsequently in clevis 53 with shaft end 50A coming into seated engagement with guide socket 29. Subsequent rotation of the guide by hand crank 51 winds the sling lines as well as the tag line which is wound intermediate the sling lines for purposes of line confinement on the guide.

Actuation of hook component 12 in remote fashion from the helicopter will release the tag line eye 39 resulting in dropping of the tag line, guide and sling lines at a site preferably near the winding mechanism above described.

Figure 10:
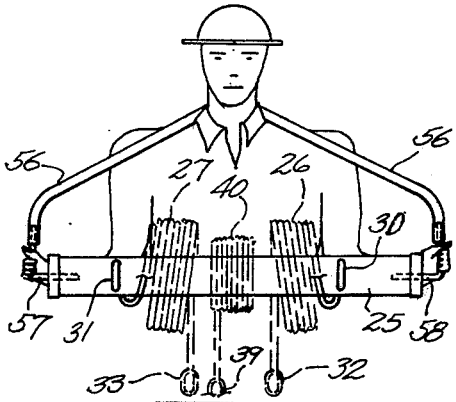
FIG. 10 is a front elevational view of a guide holder facilitating rapid unreeling of a wound sling from its guide.

In FIG. 10, a guide holder is disclosed facilitating rapid unwinding of the sling and tag lines. The holder comprises a length of tubing 56 into the ends of which are inserted right angular spindle members 57 and 58 which are manually insertable within guide sockets 29 to permit free rotation of the guide during line extraction. The load is placed along a mid-portion of the two parallel sling lines. During loading of the sling the tag line is located away from the sling lines and the load thereon.

In some applications, it may be desirable to route the sling lines through a lift ring of a load encircling cable or the like as opposed to the above described passage of the sling lines about the load.

In one suitable embodiment of the present sling system the sling lines are nylon ropes of five-eighths inch diameter and thirty-five feet in length while the tag line is of one-half inch nylon rope and twenty feet in length. The guide is approximately two and one-half feet in length with the retainer rings thereon being of a diameter to permit passage of the oblong sling line eyes therethrough during opening of the slings.

With attention again to cargo hook assembly 10, the same preferably includes a pair of insulated hand holds one of which is indicated at 60. A tubular length of dielectric material is disposed about a rod 61 which in turn is carried in an offset manner by the side rail members 13 and 14. Accordingly, ground crew members may avoid electrical shocks from static electricity.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. A sling system for the aerial transport of cargo below a prime mover and subsequent discharge of system components for attachment to a load, said sling system comprising, elongate sling means, a guide to which one end of said sling means is attached, said guide including retainers through which said sling means passes when in a load lifting configuration, a cargo hook assembly suspended from the prime mover and including independently actuated first and second hook components, the first hook component of the hook assembly securing the remaining end of said sling means in a releasable manner, said first and second hook components of the hook assembly adapted for remote and individual actuation to a release position, and a tag line extending between said second hook component of the hook assembly and said guide to impart elevation to the guide in an endwise manner subsequent to load discharge, endwise elevation of the guide by the tag line causing the released end of the load biased sling means to be drawn dowardly through the guide mounted retainers and thence out of load engagement whereupon the unloaded sling means and guide are suppported by the tag line and the hook assembly until opening of the second hook component results in dropping of the sling system at a loading site remote from the load discharge site.

2. The sling system claimed in claim 1 wherein said sling means comprises multiple sling lines each fitted with an eye for joint attachment to said first hook component.

3. The sling claimed in claim 2 wherein said tag line is attached to one end of said guide causing the guide, when elevated by the tag line, to reposition the guide and the retainers thereon to facilitate sling eye passage through the retainers.

4. The sling system claimed in claim 3 wherein said retainers are rings carried by the guide.

5. A sling system for releasable suspension from a prime mover for load attachment, said system comprising in combination, elongate flexible sling means, a guide securing one end of said sling means and including retainers through which said sling means slidably passes subsequent to sling means attachment to the load, a hook assembly carried by the prime mover and releasably securing the remaining end of said sling means, a tag line between said hook assembly and said guide for imparting elevation to said guide after hook assembly release of said remaining end of the sling means to effect upward retraction of the sling means from the load, said remaining end of said sling means being constrained by the load for downward passage through said retainers on said guide and thence out of engagement with the discharged load, and said tag line thereafter serving to carry the guide and unloaded sling means.

6. The sling system claimed in claim 5 wherein said sling means comprises multiple sling lines each fitted with an eye at their upper end for joint attachment to said first hook component.

7. The sling system claimed in claim 6 wherein said tag line when tensioned repositions said guide retainers to facilitate the downward passage of the sling eyes through said retainers.

8. The sling system claimed in claim 7 wherein said retainers are rings carried by the guide.

9. The sling system claimed in claim 7 wherein said hook assembly includes independently operable hook components to additionally releasably secure one end of the tag line whereby the tag line may be released subsequent to sling unloading to effect dropping of the sling means, guide and tag line from the hook assembly for reapplication of same to a load.

10. The sling system claimed in claim 5 additionally including a sling winder mechanism including a base, means for rotatably mounting said guide on said base, crank means on said base for imparting rotation to said guide to wind the lines attached to said guide about said guide.

* * * * *